US008872716B2

(12) United States Patent
Kinoshita

(10) Patent No.: US 8,872,716 B2
(45) Date of Patent: Oct. 28, 2014

(54) WIRELESS RECEIVER

(75) Inventor: Keisuke Kinoshita, Kyoto (JP)

(73) Assignee: Panasonic Corporation, Osaka (JP)

( * ) Notice: Subject to any disclaimer, the term of this patent is extended or adjusted under 35 U.S.C. 154(b) by 204 days.

(21) Appl. No.: 13/496,966

(22) PCT Filed: Oct. 29, 2010

(86) PCT No.: PCT/JP2010/006401
§ 371 (c)(1),
(2), (4) Date: Mar. 19, 2012

(87) PCT Pub. No.: WO2011/052225
PCT Pub. Date: May 5, 2011

(65) Prior Publication Data

US 2012/0182197 A1 Jul. 19, 2012

(30) Foreign Application Priority Data

Nov. 2, 2009 (JP) ..... 2009-251686

(51) Int. Cl.
*H01Q 9/26* (2006.01)
*H01Q 1/24* (2006.01)

(52) U.S. Cl.
USPC ..... 343/803; 343/702; 343/846

(58) Field of Classification Search
USPC ..... 343/803, 820, 846, 848, 702
See application file for complete search history.

(56) References Cited

U.S. PATENT DOCUMENTS

| | | | | |
|---|---|---|---|---|
| 5,999,831 | A | 12/1999 | Itoh | |
| 7,358,906 | B2 * | 4/2008 | Sato et al. | 343/702 |
| 7,463,200 | B2 * | 12/2008 | Gainey et al. | 343/700 MS |
| 2007/0247388 | A1 | 10/2007 | Asakura et al. | |

FOREIGN PATENT DOCUMENTS

| | | |
|---|---|---|
| JP | 60-240201 | 11/1985 |
| JP | 9-270728 | 10/1997 |
| JP | 11-163756 | 6/1999 |
| JP | 2002-319809 | 10/2002 |
| JP | 2007-194915 | 8/2007 |

* cited by examiner

*Primary Examiner* — Hoang V Nguyen
(74) *Attorney, Agent, or Firm* — Hamre, Schumann, Mueller & Larson, P.C.

(57) ABSTRACT

A wireless receiver including a dipole antenna and a circuit board, wherein high directivity characteristics can be acquired for wireless signals is provided. The wireless receiver includes a balanced feed antenna and a circuit board arranged in parallel to the longitudinal direction of the aforementioned balanced feed antenna. A conductive pattern formed on the aforementioned circuit board is composed of two or more partial patterns arranged with a gap interposed therebetween. The gap is formed at a position in between both ends of the aforementioned balanced feed antenna.

11 Claims, 10 Drawing Sheets

WIRELESS RECEIVER

TECHNICAL FIELD

The present invention relates to a wireless receiver that receives data and television broadcast by receiving radio waves traveling in the air. In particular, the present invention relates to a wireless receiver having a balanced feed antenna arranged at a position spatially close to a circuit board arranged within the receiver.

BACKGROUND ART

As a result of the recent technical developments for portable phones and terrestrial digital broadcasting, wireless receivers that receive data, audio, television broadcast and the like by use of wireless radio waves without wire communications have been widespread. For receiving wireless radio waves, the wireless radio waves are converted into electric signals by use of an antenna or the like, and then the signals are subjected to amplification, demodulation, signal processing and the like so as to decode the data.

Examples of antennas frequently used for portable equipment include a monopole antenna, a dipole antenna, a reversed F antenna and the like. Among them, a dipole antenna as a balanced feed antenna has figure-eight directivity characteristics, and thus if its directivity is expressed on a plane, the antenna has symmetric directivity characteristics with a feeding point 3 of the dipole antenna 1 at the center as shown in FIG. 14. The dipole antenna has directivity characteristics of rotational symmetry about the axis, and thus, when the dipole antenna is established horizontally to the ground, it exhibits the figure-eight directivity characteristics not only relative to a plane horizontal to the ground but similarly to a plane vertical to the ground.

A basic dipole antenna has the above-mentioned directivity characteristics. It is possible to enhance the directivity characteristics by forming the antenna in combination with a director and/or a reflector.

FIG. 15 shows the differences in the antenna directivity characteristics when combining a dipole antenna with a director and a reflector. As shown in FIG. 15B, in a case where a director 4 is arranged in front of the dipole antenna 1 and a reflector 5 is arranged behind, in comparison with a case as shown in FIG. 15A where the same dipole antenna 1 is used alone, the directivity is enhanced in the direction of the director 4 when viewed from the dipole antenna 1 as a radiator (i.e., a direction opposite to the reflector 5), and thus even a weak radio wave can be received.

The directivity characteristics of the dipole antenna can be changed by use of the reflector alone, and thus, more intensive directivity characteristics or wider directivity characteristics can be provided by modifying the shape of the reflector (see for example Patent Document 1).

PRIOR ART DOCUMENTS

Patent Document

Patent Document 1: JP 2007-194915 A

DISCLOSURE OF INVENTION

Problem to be Solved by the Invention

However, when arranging a dipole antenna 1 within a wireless receiver 100 as shown in FIG. 12, the conductive patterns such as a ground (GND) pattern and a power source pattern formed on a circuit board 2 arranged within a housing 9 of the wireless receiver 100 define a metallic conductor that is arranged in parallel to the dipole antenna 1 and that has a predetermined surface area and a predetermined length in the longitudinal direction of the dipole antenna 1. The conductive pattern functions as a reflector for the dipole antenna 1. As a result, as indicated with an arrow A in FIG. 12, the directivity characteristics of the dipole antenna 1 will be directed upward from the wireless receiver 100.

FIG. 13 shows a change in the directivity characteristics in a case where the dipole antenna 1 is arranged within the wireless receiver 100.

FIG. 13A shows the positional relationship between the dipole antenna 1 and the circuit board 2 in a horizontal direction when viewed from above the wireless receiver 100, and the change in the directivity characteristics for this positional relationship. FIG. 13B shows the positional relationship between the dipole antenna 1 and the circuit board 2 in a vertical direction when viewed from the front of the wireless receiver 100, and the change in the directivity characteristics for this positional relationship.

Since the conductive pattern (not shown) formed on the circuit board 2 functions as a reflector, the directivity characteristics in the vertical direction of the dipole antenna 1 change from the vertically-symmetric directivity characteristics indicated as a dotted line 'c' in FIG. 13B (for a state without the circuit board 2) to the directivity characteristics indicated as solid lines d1 and d2. Namely, the directivity characteristic d1 directed upward is increased and the directivity characteristic d2 directed downward is decreased. As a result, the directivity characteristics relative to the horizontal direction change from the state indicated with a dotted line 'a' (for a state without the circuit board 2) to the state indicated with a solid line 'b' in FIG. 13A. Namely, the symmetry in the back and forth direction is maintained but the entire intensity in the directivity characteristics is degraded. As a result, the antenna characteristics in the horizontal direction of the wireless receiver 100 will be degraded.

For receiving TV broadcast of terrestrial digital broadcasting, in a case where the wireless receiver 100 is a portable television receiver for example, radio waves to be received arrives in a direction horizontal to the wireless receiver 100 in an ordinary use state. Therefore, when the directivity characteristics in the horizontal direction of the dipole antenna 1 (indicated with arrows B1 and B2 in FIG. 12) are degraded as mentioned above, a problem occurs, namely, the reception performance of the wireless receiver 100 is degraded considerably.

Therefore, with the foregoing in mind, it is an object of the present invention to provide a wireless receiver including a dipole antenna and a circuit board so as to provide high directivity characteristics for wireless signals.

Means for Solving Problem

For achieving the above-mentioned object, a wireless receiver of the present invention is characterized in that it includes a balanced feed antenna and a circuit board arranged in parallel to the longitudinal direction of the balanced feed antenna. A conductive pattern formed on the circuit board is composed of two or more partial patterns arranged with a gap interposed therebetween, and the gap is formed at a position in between both ends of the balanced feed antenna.

Effects of the Invention

In the wireless receiver of the present invention, a conductive pattern formed on a circuit board is divided into two or more partial patterns by a gap formed at a position in between both ends of a balanced feed antenna. Therefore, degradation in the directivity characteristics in the horizontal direction of the balanced feed antenna can be avoided, and a wireless receiver with higher reception performance for wireless signals can be obtained.

DESCRIPTION OF THE INVENTION

Figure 1:
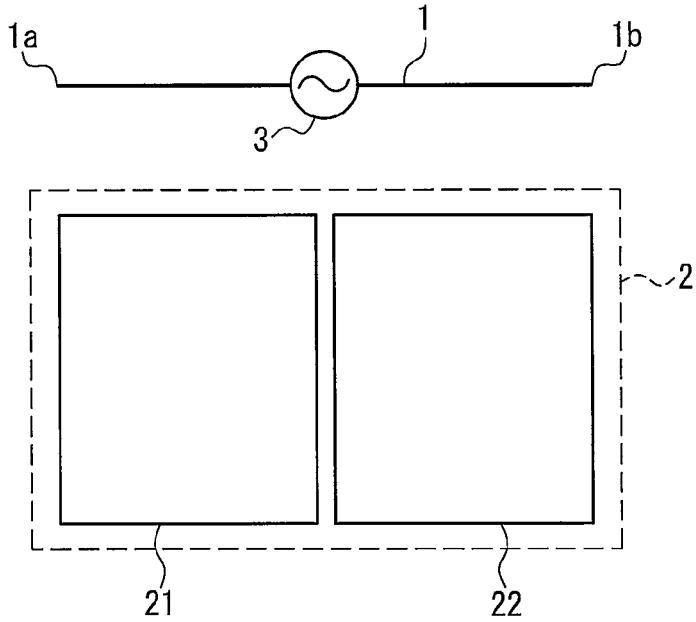
FIG. 1 is a diagram showing an example of a schematic configuration of a wireless receiver according to Embodiment 1 of the present invention.

A wireless receiver of the present invention includes a balanced feed antenna and a circuit board arranged in parallel to the longitudinal direction of the balanced feed antenna. A conductive pattern formed on the circuit board is composed of two or more partial patterns arranged with a gap interposed therebetween, and the gap is formed at a position in between both ends of the balanced feed antenna.

According to the above-mentioned configuration, in the wireless receiver of the present invention, even if the balanced feed antenna and the circuit board are arranged within the receiver with a short distance therebetween, the conductive patterns formed on the circuit board will be discontinued by the gap formed between the both ends of the balanced feed antenna, and thus partial patterns shorter than the length of the balanced feed antenna are formed. Therefore, the conductive patterns can be prevented effectively from functioning as a reflector for the balanced feed antenna, and thus, it is possible to prevent degradation in the antennal directivity characteristics in the horizontal direction, namely the direction in which the wireless signals to be received will arrive.

In the wireless receiver of the present application, it is preferable that the circuit board is composed of two or more partial boards arranged in the longitudinal direction of the balanced feed antenna, so that the conductive pattern is composed of two or more partial patterns. As the circuit board is composed of partial boards, the conductive patterns formed on the boards can be made as reliably separated partial patterns.

It is also preferable that the conductive pattern is a ground pattern to be connected to a ground potential. In many cases, a ground pattern of a large surface area is formed on the circuit board. By providing this ground pattern as partial patterns, the ground pattern can be prevented reliably from functioning as a reflector for the balanced feed antenna.

Further it is preferable that the two or more partial patterns are connected to each other with an interconnect line arranged on the circuit board distally relative to the balanced feed antenna. Thereby, it is possible to keep the partial patterns equipotential due to the connection between the partial patterns while preventing the conductive patterns from functioning as a reflector for the balanced feed antenna.

Furthermore, in a case where the conductive pattern is a ground pattern, it is preferable that the two or more partial patterns are connected to each other with a low-pass circuit portion. Further in such a case, it is preferable that the low-pass circuit portion does not transmit a frequency band component of a signal received by the balanced feed antenna. In this manner, the connection between the ground patterns can be ensured, and at the same time, the ground patterns can be regarded as substantially separated for wireless signals received by the balanced feed antenna.

Further, in a case where the conductive pattern is a ground pattern, it is preferable that the two or more partial patterns are connected to each other with a resistive circuit element. In this manner, the ground patterns can be made equipotential in a state where influences on the wireless signals to be received by the balanced feed antenna are reduced.

It is preferable that the balanced feed antenna is arranged at a position on an extension of the circuit board. Thereby, degradation in the directivity characteristics can be prevented effectively under the condition where the conductive patterns of the circuit board function easily as the reflector for the balanced feed antenna.

Further, it is possible that the balanced feed antenna is arranged above the circuit board during use of the wireless receiver. And furthermore, it is possible that the balanced feed antenna is arranged laterally relative to the circuit board during use of the wireless receiver.

Further it is possible that the balanced feed antenna is a dipole antenna. And it is possible that the balanced feed antenna is a folded dipole antenna.

Hereinafter, embodiments of the wireless receiver of the present application will be described with reference to the attached drawings.

Embodiment 1

FIG. 1 is a diagram showing a positional relationship between a circuit board and a dipole antenna in a wireless receiver according to the present embodiment.

Figure 12:
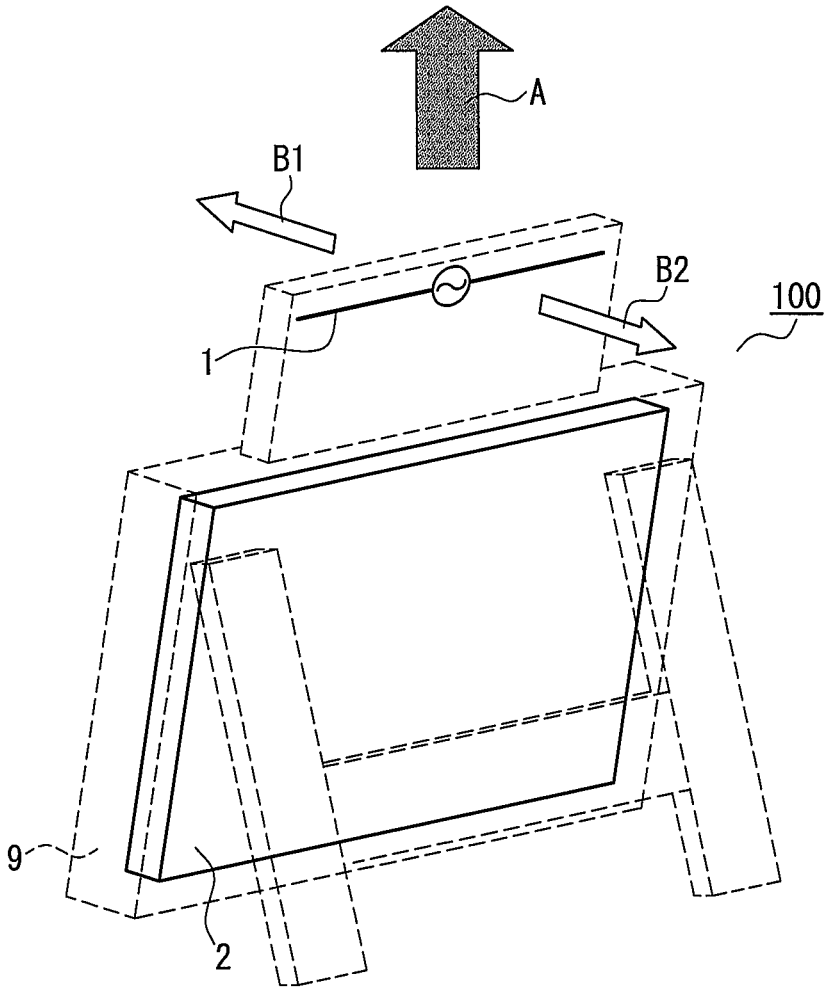
FIG. 12 PRIOR ART
FIG. 12 is a diagram showing a positional relationship between a housing, a circuit board and an antenna in a wireless receiver.

The general configuration of the wireless receiver in the present embodiment is the same as that shown in FIG. 12. The wireless receiver includes a dipole antenna 1 as a balanced feed antenna, a circuit board 2, and a feeding point 3. In the present embodiment, elements other than the antenna and the circuit boards for an ordinary wireless receiver can be employed directly. In a case where the wireless receiver is a portable television receiver, examples of the other elements include an image display device, a speaker, a rechargeable battery and the like. Therefore in the present specification, the respective elements including the housing of the wireless receiver are not shown or not explained in detail. It should be noted also that the present application is not limited to the television receiver as an example for the wireless receiver, but various wireless receivers including antennas for receiving signals and circuit boards for driving the equipment can be used for this purpose.

The dipole antenna 1 is arranged so that the longitudinal direction becomes parallel to the circuit board 2. In the present embodiment, the dipole antenna 1 is arranged at a position on the extension of the circuit board 2 in the planar direction. This arrangement is selected by taking into consideration a positional relationship in which the influence of the circuit board 2 becomes the greatest in simulating the directivity characteristics of the dipole antenna 1 for a below-mentioned case where the circuit board 2 is positioned in the vicinity. Therefore, in the wireless receiver of the present embodiment, the dipole antenna 1 is not necessarily at a position on a planar extension of the circuit board 2, but the dipole antenna 1 may be positioned with a little shift forward or backward relative to the position on the extension of the circuit board 2, depending on the relationship with the other elements to be contained in the housing of the wireless receiver. Further in the present embodiment, the description that the dipole antenna 1 and the circuit board 2 are arranged in parallel indicates an arrangement in which the longitudinal direction of the dipole antenna 1 is oriented substantially the same as the circuit board 2. There is no necessity that the dipole antenna 1 is arranged so that the longitudinal direction be exactly parallel to the circuit board 2.

As shown in FIG. 1, the circuit board 2 of the present embodiment is composed of two partial boards, i.e., a first partial board 21 and a second partial board 22 arranged with a gap positioned at a feeding point 3 of the dipole antenna 1, namely, in the middle part in the longitudinal direction of the dipole antenna 1.

On the circuit board 2, a wiring pattern is formed to feed a power source potential or signals to electronic circuit elements to be mounted. In many cases, for reducing the wiring resistive component on the circuit board 2, a conductive pattern having a width greater than a width of a linear wiring is formed. In particular, a part to be connected to a power source potential where a large current flows is formed as a power source pattern, while a part to be connected to a ground potential (GND: earth potential) is formed as a ground pattern.

In some cases, for reducing the surface area of the board, a plurality of boards each having a wiring pattern formed on one or both surfaces are laminated via insulating layers so as to form a multilayered circuit board to be used as the circuit board 2. Generally in the multilayered circuit board, a board composing any of the layers is formed as a power source layer having a large island power source pattern connected to the power source potential, and a board composing the other layer is formed as a ground layer to be connected to the ground potential.

The circuit board 2 of the present embodiment is composed of two partial boards 21 and 22. Therefore, any of the conductive patterns such as the power source pattern and the ground pattern formed on the first partial board 21 and the conductive patterns such as the power source pattern and the ground pattern formed on the second partial board 22 will not be present continuously in the longitudinal direction of the dipole antenna 1, but they are formed as two partial patterns having a length shorter than the length of the dipole antenna 1. As mentioned above, in the wireless receiver of the present embodiment, the conductive pattern on the circuit board 2 is not formed to have a length equal to or longer than that of the dipole antenna 1 in the direction of the length direction of the dipole antenna 1. Therefore, it is possible to avoid the problem as explained with reference to FIGS. 12 and 13, namely, a problem that a conductive pattern of the circuit board 2 arranged in the vicinity of the dipole antenna 1 functions as a reflector. As a result, it is possible to prevent degradation in the reception characteristics in the horizontal direction of the dipole antenna 1.

Figure 2:
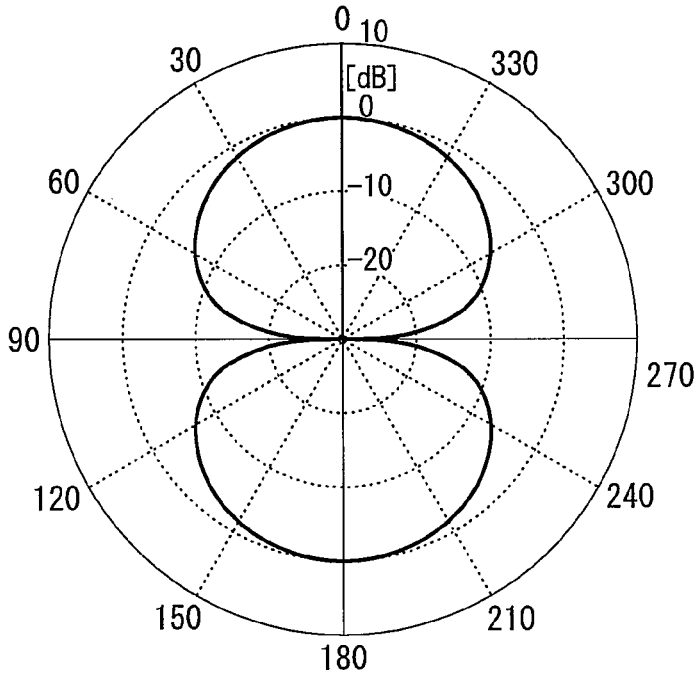
FIG. 2 is a diagram showing directive characteristics of a dipole antenna in a wireless receiver according to Embodiment 1 of the present invention.

FIG. 2 shows the reception characteristics of the dipole antenna 1 in the wireless receiver of the present embodiment.

FIG. 2 shows a simulation result for the antenna characteristics when the distance between the both ends 1*a* and 1*b* of the dipole antenna 1 is about 260 mm; each of the first partial board 21 and the second partial board 22 includes a ground pattern sized 150 mm in length, 125 mm in width and 0.1 mm in thickness; the gap between the first partial board 21 and the second partial board 22 is 10 mm; and the distance from the dipole antenna 1 to the first partial board 21 and the second partial board 22 is 50 mm. In FIG. 2, the upper angle of 0 degree denotes the normal direction of the first partial board 21 and the second partial board 22, i.e., the characteristics of a horizontally polarized wave at a frequency of 500 MHz. In the present embodiment, the directivity characteristics of the dipole antenna 1 exhibit a peak value of 0.3 dBi at angles of 0 degree and 180 degrees.

Figure 3:
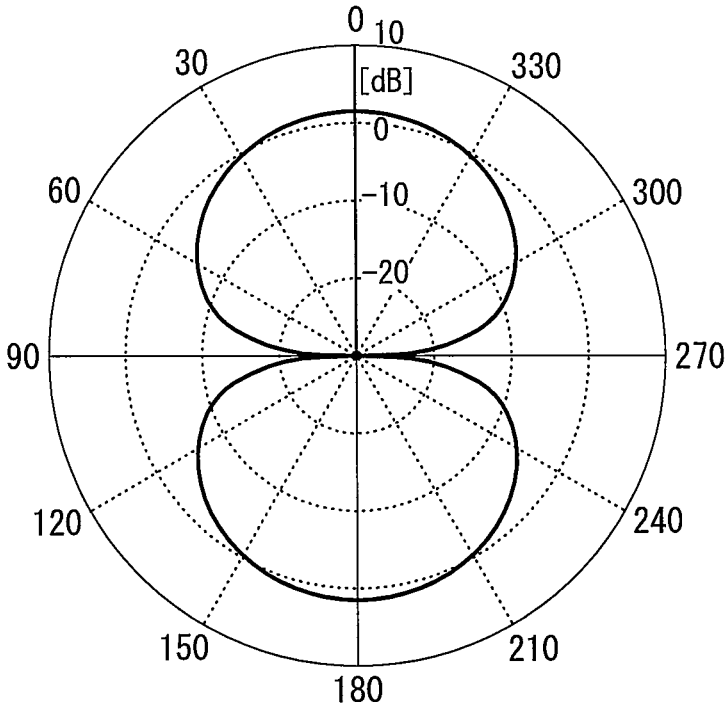
FIG. 3 is a diagram showing directivity characteristics of Comparative Example 1 regarding a case where a dipole antenna is used alone.

FIG. 3 shows the antenna characteristics of Comparative Example 1 where the dipole antenna 1 is provided alone but the circuit board 2 is not provided. As shown in FIG. 3, in this case, the peak value is 1.2 dBi at angles of 0 degree and 180 degrees.

Figure 4:
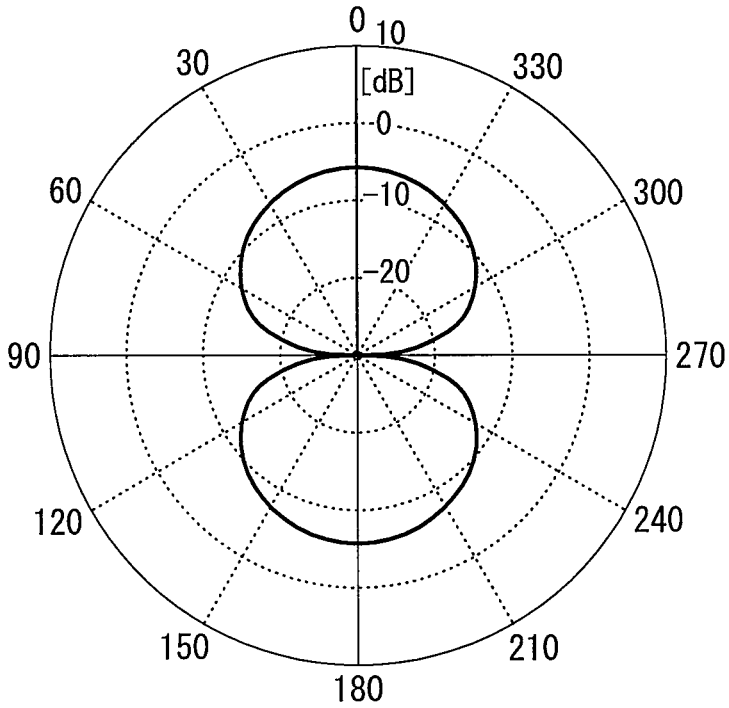
FIG. 4 is a diagram showing directivity characteristics of Comparative Example 2 regarding a case of a circuit board not being composed of partial boards.
Figure 13A:
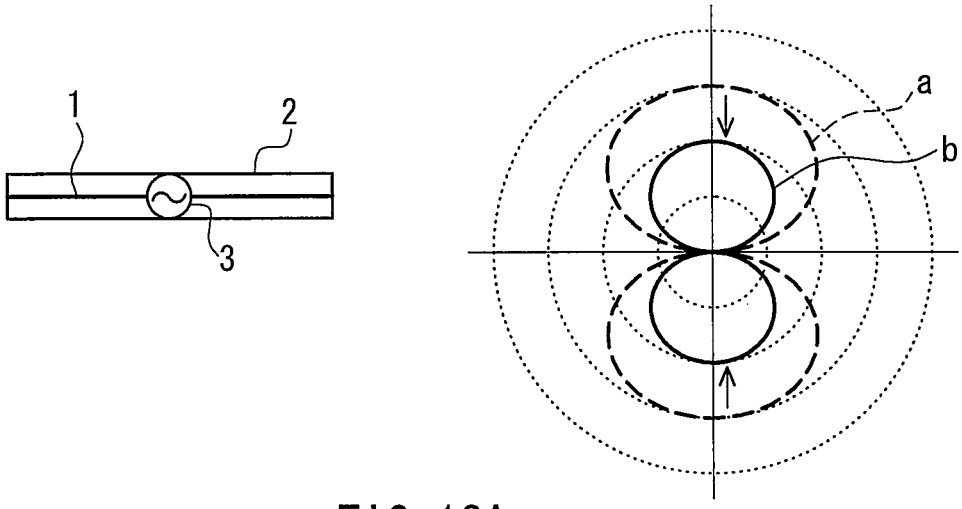
FIG. 13A PRIOR ART
FIGS. 13(*a*) and 13(*b*) are diagrams showing an influence imposed on antenna directivity characteristics by a circuit board of a wireless receiver.
Figure 13B:
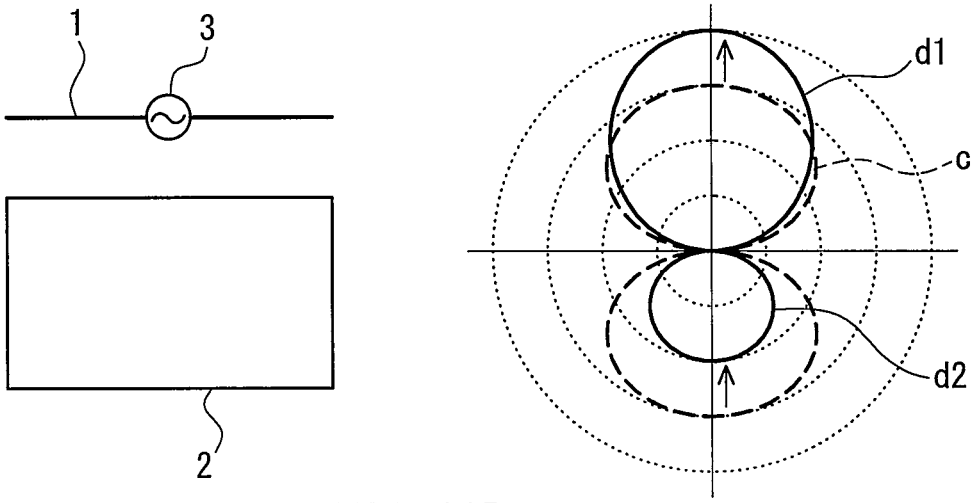
FIG. 13B PRIOR ART
Figure 14:
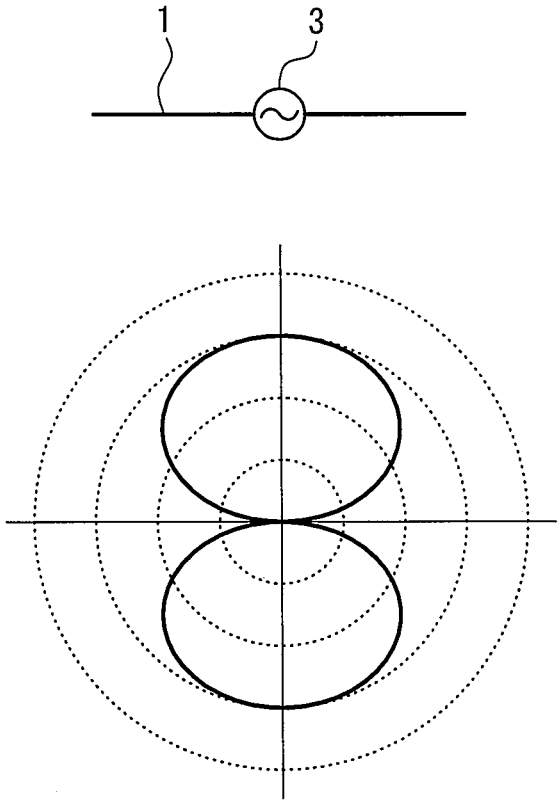
FIG. 14 PRIOR ART
FIG. 14 is a diagram showing directivity characteristics of a dipole antenna alone.
Figure 15A:
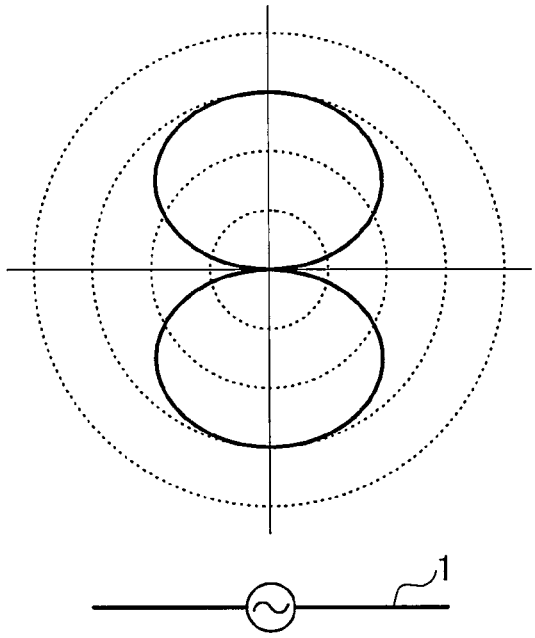
FIG. 15A PRIOR ART
FIGS. 15(*a*) and 15(*b*) are diagrams showing a change in the directivity characteristics of a dipole antenna regarding a case where a director and a reflector are provided.
Figure 15B:
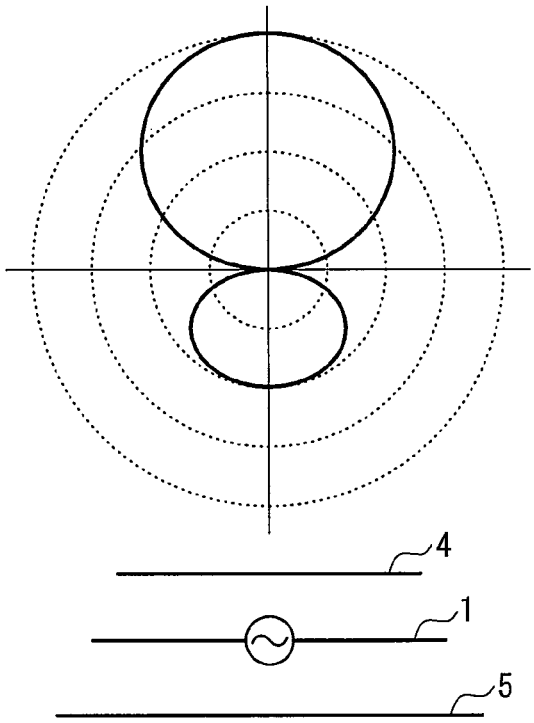
FIG. 15B PRIOR ART

FIG. 4 shows antenna characteristics of Comparative Example 2 where the circuit board 2 is not formed as partial boards but as a single board as shown in FIGS. 12 and 13. In a case where the transverse length of the circuit board 2 is the same as the 260 mm of the distance between the both ends 1*a* and 1*b* of the dipole antenna 1, the antenna characteristics deteriorate considerably in comparison with the cases as shown in FIGS. 2 and 3. The peak value is −5.1 dBi at angles of 0 degree and 180 degrees.

Namely, in a case of Comparative Example 2 as shown in FIGS. 12 and 13 where the circuit board 2 is not composed of partial boards, the characteristics of the dipole antenna 1 are degraded by 6.3 dB in comparison with Comparative Example 1 where the circuit board 2 is not provided. In contrast, in a case of the wireless receiver of the present embodiment, where the circuit board 2 is composed of the first partial board 21 and the second partial board 22 as shown in FIG. 1, the characteristics of the dipole antenna 1 is improved by 5.4 dB in comparison with the Comparative Example 2.

As mentioned above, in a wireless receiver where the dipole antenna 1 is arranged together with the circuit board 2 within the housing and the distance between the dipole antenna 1 and the circuit board 2 is comparatively short, the circuit board 2 is formed as two partial boards of the first substrate 21 and the second substrate 22, thereby providing a wireless receiver where the antenna directivity of the dipole antenna 1 is prevented from being directed upward to cause degradation in the antenna characteristics in the horizontal direction.

Figure 5:
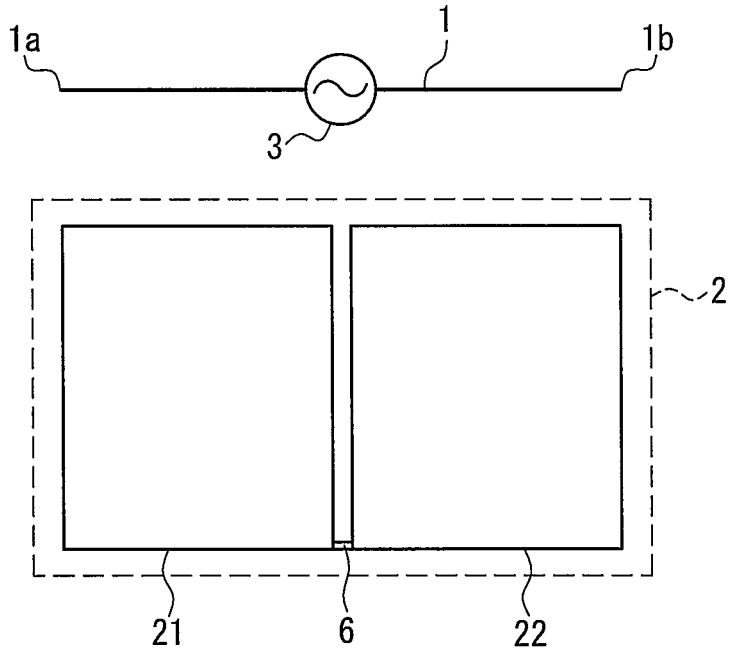
FIG. 5 is a diagram showing an example of a schematic configuration of a wireless receiver according to an application example of Embodiment 1 of the present invention.

FIG. 5 is a diagram showing a schematic configuration of wireless receiver according to an application example of the present embodiment. FIG. 5 shows the positional relationship between the dipole antenna 1, the circuit board 2 and the feeding point 3, each arranged within the housing (not shown) of the wireless receiver, corresponding to FIG. 1 that shows the schematic configuration of a wireless receiver of the present embodiment.

In the wireless receiver of the application example as shown in FIG. 5, in the circuit board 2 composed of the two partial boards of the first partial board 21 and the second partial board 22, an interconnect line 6 is provided for connecting the ground patterns on the two partial boards 21 and 22. Since the remaining elements are the same as those of the case shown in FIG. 1, identical signs are assigned to avoid duplicated explanation.

In the circuit board 2 to activate the electronic equipment, for activating stably the circuit mounted on the board, it is preferable that the ground potential (0V) is standardized. For this purpose, in some cases, it is preferable that the ground patterns of the first partial board 21 and the second partial board 22 configured as the two partial boards are connected directly to each other. In such a case, as shown in FIG. 5, the interconnect line 6 that connects the ground patterns of the first partial board 21 and the second partial board 22 is arranged on the two partial boards 21 and 22 distally relative to the dipole antennal 1.

As mentioned above, in the wireless receiver of the present embodiment, the circuit board 2 is formed as two partial boards, and thus the conductive pattern on the circuit board 2 is made as two partial patterns discontinuous in the longitudinal direction of the dipole antenna 1. As a result, the conductive pattern formed on the circuit board 2 is prevented from functioning as a reflector for the dipole antenna 1. Therefore, a direct connection of the ground patterns as the partial patterns negatively affects the improving of the reception characteristics of the dipole antenna 1. However, since the interconnect line 6 for connecting the partial patterns is arranged on the partial boards 21, 22 distally relative to the dipole antenna 1, it is possible to suppress to the minimum the influence of the ground patterns connected with the interconnect line 6 functioning as a reflector.

Regarding the partial boards 21 and 22 in FIG. 5, a side distal relative to the dipole antenna 1 is not limited to the lower end opposite to the side where the dipole antenna 1 is arranged. The interconnect line 6 can be provided anywhere on substantially the half the surface areas of the partial boards 21, 22 distal relative to the dipole antenna 1, namely, the lower half area of each of the partial boards 21, 22 in FIG. 5, so as to exhibit an effect of avoiding degradation in the reception characteristics of the dipole antenna 1. With regard to the interconnect line 6, it is preferable to use a thinner line as long as the object of connecting the ground potentials of the first partial board 21 and the second partial potential 22 for the purpose of stabilizing the circuit operation is achieved, i.e., as long as the wiring resistance in the width is not regarded as causing any substantial problems.

The application example of the present embodiment refers to connecting the ground patterns of the first partial board 21 and the second partial board 22 with the interconnect line 6. In an alternative case, for the purpose of activating stably the electronic circuit elements mounted on the circuit board 2, it is preferable to connect directly the power source patterns of the first partial board 21 and the second partial board 22. In this case, similarly to the case of the interconnect line 6 as shown in FIG. 5, it is preferable that the interconnect line for connecting the power source patterns is arranged on the first partial board 21 and the second partial board 22 distally relative to the dipole antenna 1.

Although the balanced feed antenna in the above description of the present embodiment is explained with reference to a dipole antenna, it also is possible to use other types of balanced feed antennas such as a folded dipole antenna.

In the present embodiment, both the first partial board 21 and the second partial board 22 are shaped rectangular, and the gap formed between the substrates is shaped linearly. However, the gap between the two partial boards may have at least one angle or curve. The first partial board 21 and the second partial board 22 are not restricted further as long as they are provided as two partial boards not being linked physically in the longitudinal direction of the dipole antenna 1, and the conductive patterns such as the power source patterns and the ground patterns formed on the respective partial boards 21 and 22 compose partial patterns arranged with a gap interposed therebetween in the longitudinal direction of the dipole antenna 1.

Further, in the present embodiment, the first partial board 21 and the second partial board 22 are partial boards formed by dividing the circuit board 2 into equal halves in size by interposing a gap at the part of the feeding point 3 in the middle part of the dipole antenna 1. However, the gap between the two partial boards of the circuit board 2 is not necessarily positioned at the part of the feeding point 3 of the dipole antenna 1, as long as the gap is formed at a position in between one end 1*a* and the other end 1*b* of the dipole antenna 1, namely, at a position in between the both ends of the dipole antenna 1, to thereby form two partial boards. In this case, the first partial board 21 and the second partial board 22 are shaped asymmetrical with respect to a virtual partition formed in the gap. There is no problem in the asymmetry as long as the dimension of the partial boards 21 and 22 in the longitudinal direction of the dipole antenna, i.e., the dimension in the transverse direction in FIGS. 1 and 5, is smaller than the distance between the both ends 1*a* and 1*b* of the dipole antenna 1.

Though the present embodiment refers to an example of forming the circuit board 2 with two partial boards of the first partial board 21 and the second partial board 22, the circuit board 2 may be formed of three or more partial boards.

There is no particular limitation on the circuit configuration to be formed on the partial board. For the purpose of mounting elements for forming a circuit to exhibit a group of functions, partial boards are provided by dividing a circuit that is in general mounted on a single board into two or more circuits together with the board. Alternatively, two or more boards for forming a circuit exhibiting separate functions are arranged in the longitudinal direction of the dipole antenna. In this case, the respective boards compose the partial boards of the present embodiment.

Embodiment 2

Next, a wireless receiver of Embodiment 2 will be described.

Figure 6:
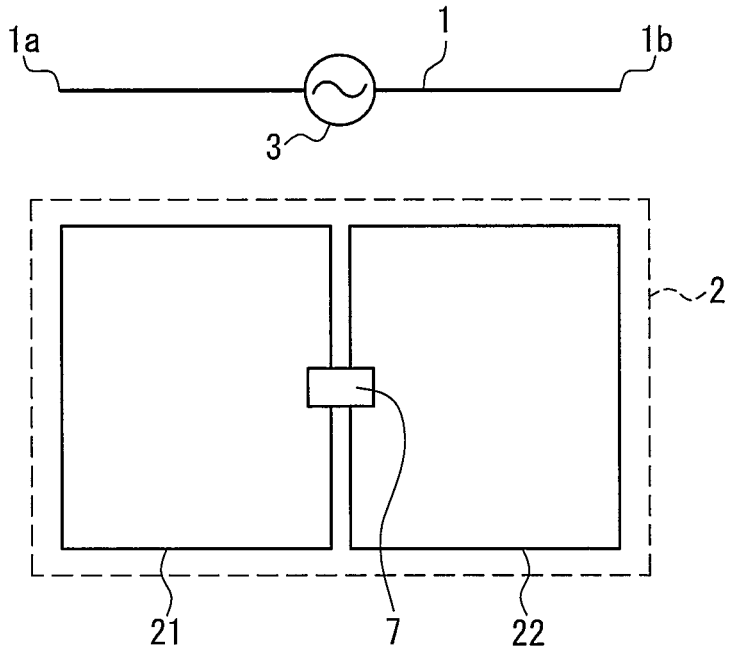
FIG. 6 is a diagram showing an example of a schematic configuration of a wireless receiver according to Embodiment 2 of the present invention.

FIG. 6 is a diagram showing a schematic configuration of a wireless receiver according to Embodiment 2. FIG. 6 shows the positional relationship between a dipole antenna 1, a circuit board 2 and a feeding point 3, each arranged within a housing (not shown) of the wireless receiver. FIG. 6 corresponds to FIG. 1 showing a schematic configuration of a wireless receiver in Embodiment 1.

In the wireless receiver according to Embodiment 2 as shown in FIG. 6, ground patterns formed respectively on a first partial board 21 and a second partial board 22 composing the circuit board 2 are coupled to each other by a low-pass circuit portion 7.

The low-pass circuit portion 7 in the present embodiment is a low-pass filter formed of an inductor, capacitor or the like. The low-pass circuit portion 7 has a characteristic of not transmitting a signal component of about 500 MHz within a reception signal frequency band to be received by the wireless receiver of the present embodiment but transmitting a lower pass frequency band component including a direct current.

By connecting the ground pattern of the first partial board 21 and the ground pattern of the second partial board 22 with the low-pass circuit portion 7, the ground potentials of the partial boards 21 and 22 are equalized. As a result, many disadvantages that are caused when the ground potentials vary among the circuit boards are avoided, where examples of the disadvantages include that the circuits cannot be upgraded and that the potential relationship between the circuits cannot be stabilized. Furthermore, in the frequency band of the reception signal received by the dipole antenna 1, the two partial boards 21 and 22 can be kept in a substantially electrically separated state. Therefore, the ground potentials of the partial boards 21, 22 are standardized and similarly to the case of the wireless receiver as mentioned in Embodiment 1, it is possible to avoid degradation in the antenna characteristics in the horizontal direction of the dipole antenna 1.

Figure 7:
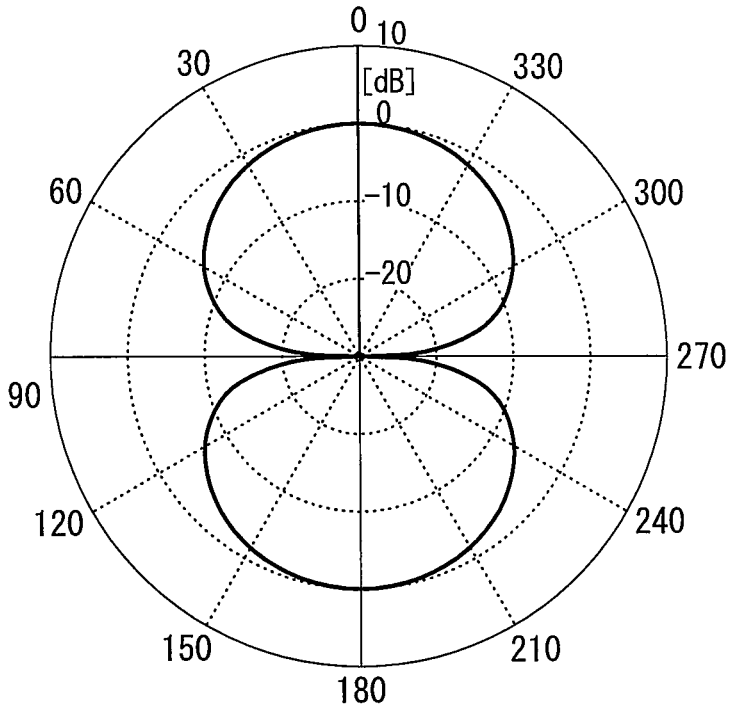
FIG. 7 is a diagram showing directive characteristics of a dipole antenna in a wireless receiver according to Embodiment 2 of the present invention.

FIG. 7 shows a simulation result of antenna characteristics in the horizontal direction at the time of connecting the first partial board 21 and the second partial board 22 with the low-pass circuit portion 7 as shown in FIG. 6.

In the simulation, the dimensions such as the sizes of the dipole antenna 1, the two partial boards 21, 22 and the gaps were as same as those relating to FIG. 2 for Embodiment 1, and the low-pass circuit portion 7 was an inductor of 1 μH.

As a result, as shown in FIG. 7, the reception characteristics of the dipole antenna 1 were similar to those of Embodiment 1 as shown in FIG. 2. Namely, at the frequency of 500 MHz, the peak value was 0.3 dBi at the angle of 0 degree and the angle of 180 degrees, which was improved by 5.4 dB in comparison with a case as shown in FIG. 4 of Comparative Example 2 where a single circuit board 2 not comprising partial boards is used.

As mentioned above, in a wireless receiver having the dipole antenna 1 and the circuit board 2 both of which are arranged within a housing and the distance between the dipole antenna 1 and the circuit board 2 is short, the circuit board 2 is composed of two partial boards of the first partial board 21 and the second partial board 22, and the ground layers thereof are connected to each other with the low-pass circuit portion 7. This provides a wireless receiver that keeps the ground potentials of the two partial boards 21, 22 equal, and that can avoid degradation in the antenna characteristics in the horizontal direction of the dipole antenna 1.

The present embodiment is similar to the above-mentioned Embodiment 1 in that any other balanced feed antennas such as a folded dipole antenna can be used for the balanced feed antenna, and that the shape of the gap between the first partial board 21 and the second partial board 22 is not limited to the linear example but other shapes can be employed as long as the conductive patterns formed on the respective partial boards 21, 22 are the partial patterns separated by the gap in the longitudinal direction of the dipole antenna 1. Further, similarly to the above embodiment, in the wireless receiver of the present embodiment, the gap that divides the circuit board 2 into the partial boards 21, 22 is not necessarily positioned at the feeding point 3 of the dipole antenna 1. Furthermore, the circuit board 2 can be composed of three or more partial boards. The circuit board 2 may be provided by dividing one board for mounting a circuit integrated from the viewpoint of functions, or a plurality of boards formed to mount separate circuits may be arranged in the longitudinal direction of the dipole antenna 1.

The present embodiment refers to a case of using an inductor (1 μH) for the low-pass circuit portion 7 as the example. For the low-pass circuit portion 7, a conventionally known low-pass filter or the like using an inductor and a capacitor can be used. Further, it is preferable that the low-pass circuit portion 7 does not transmit a signal frequency received by the dipole antenna 1. However, this is not essential, as long as the circuit portion has the property of transmitting a low-frequency component approximate to a direct current while shielding a frequency component in a high frequency band to be received by the antenna.

Embodiment 3

Next, a wireless receiver of Embodiment 3 will be described.

Figure 8:
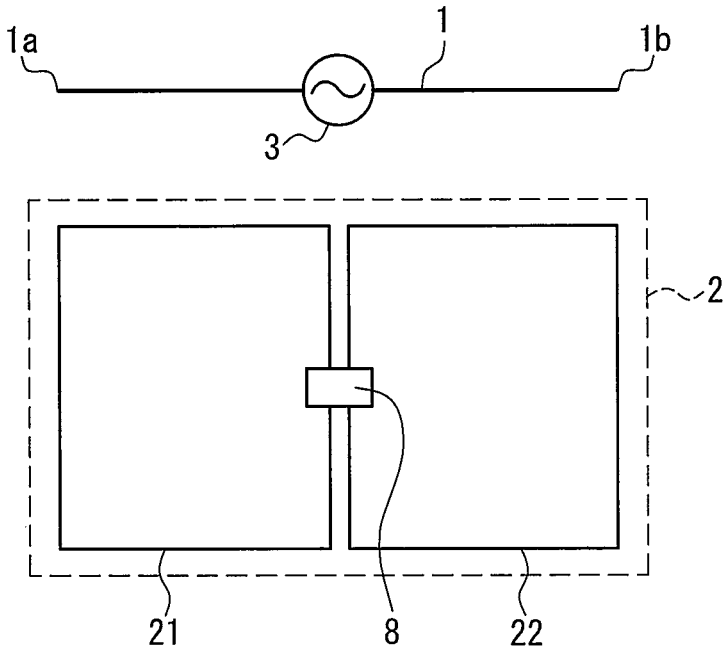
FIG. 8 is a diagram showing an example of a schematic configuration of a wireless receiver according to Embodiment 3 of the present invention.

FIG. 8 is a diagram showing a schematic configuration of a wireless receiver according to Embodiment 3. FIG. 8 shows the positional relationship between a dipole antenna 1, a circuit board 2 and a feeding point 3, each arranged within a housing (not shown) of the wireless receiver. FIG. 8 corresponds to FIG. 1 showing a schematic configuration of a wireless receiver in Embodiment 1.

In the wireless receiver according to Embodiment 3 as shown in FIG. 8, ground patterns formed respectively on a first partial board 21 and a second partial board 22 composing the circuit board 2 are coupled to each other by a resistive circuit element 8.

If the ground pattern of the first partial board 21 and the ground pattern of the second partial board 2 are connected to each other with the resistive circuit element 8, even when the ground potentials of the two partial boards 21 and 22 are differentiated from each other at some point in time, a fine current flows through the resistive circuit element 8 and thus the ground potentials will shift to an equipotential state over time. On the other hand, due to the connection with the resistive circuit element 8, the ground patterns do not track any short period changes in potentials, and thus in the frequency band of reception signal received by the dipole antenna 1, the first partial board 21 and the second partial board 22 can be kept just like being separated electrically from each other.

Similarly to the above-mentioned embodiments, in the wireless receiver of the present embodiment, the ground potentials of the two partial boards 21, 22 become equal. Therefore, the disadvantages caused by the difference in the ground potentials can be avoided, and at the same time, in the frequency band to be received by the dipole antenna 1, the ground patterns formed on the two partial boards can be separated electrically from each other. As a result, similarly to Embodiment 1 and Embodiment 2, degradation in the antenna characteristics in the horizontal direction of the dipole antenna 1 can be avoided.

Figure 9:
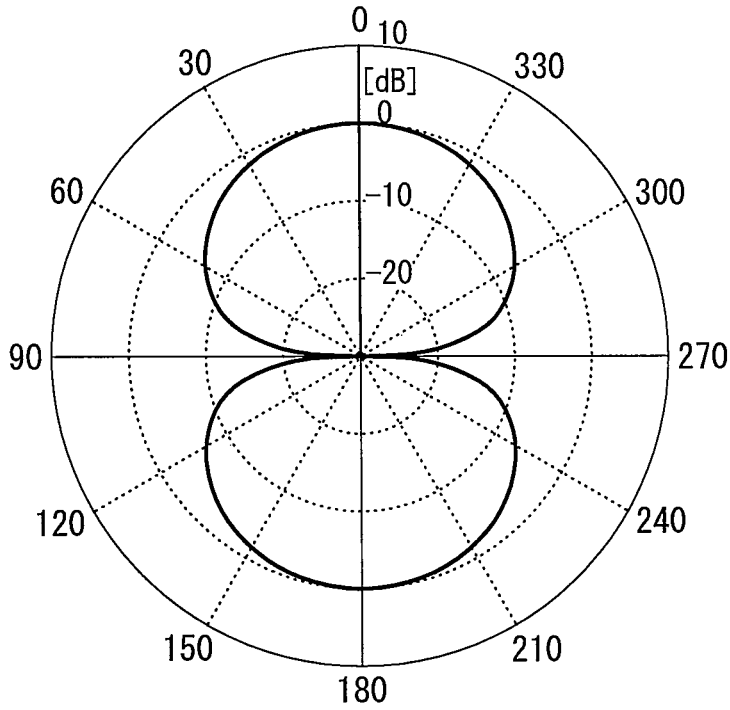
FIG. 9 is a diagram showing directivity characteristics of a dipole antenna in a wireless receiver according to Embodiment 3 of the present invention.

FIG. 9 shows a simulation result of the antenna characteristics at the time of connecting the ground patterns of the first partial board 21 and the second partial board 22 with the resistive circuit element 8 for the schematic configuration shown in FIG. 8. Regarding the simulation as shown in FIG.

9, the dimensions of the respective parts of the dipole antenna 1, the first partial board 21 and the second partial board 22 are similar to those of Embodiment 1 as shown in FIG. 2 and those of Embodiment 2 as shown in FIG. 7. The simulation refers to a case where a 10 MΩ resistor was used for the resistive circuit element 8.

The result is shown in FIG. 9. Regarding the reception characteristic of the dipole antenna 1, at the frequency of 500 MHz, the peak value was 0.2 dBi at an angle of 0 degree and 180 degrees, which is evidently improved by 5.3 dB in comparison with a case of Comparative Example 2 having a single continuous circuit board 2 as shown in FIG. 4.

As mentioned above, in a wireless receiver having the dipole antenna 1 and the circuit board 2 both of which are arranged within a housing and the distance between the dipole antenna 1 and the circuit board 2 is short, the circuit board 2 is composed of two partial boards of the first partial board 21 and the second partial board 22 and the ground patterns of the two partial boards 21, 22 are connected to each other with the resistive circuit element 8. This provides a wireless receiver that keeps the ground potentials at the ground patterns formed on the two partial boards 21, 22 equal, and that can avoid degradation in the antenna characteristics in the horizontal direction of the dipole antenna 1.

Similarly to the other embodiments, in the present embodiment, other types of balanced feed antennas such as a folded dipole antenna can be used for the balanced feed antenna. And there is not any particular limitation on the shape of the gap between the first partial board 21 and the second partial board 22, as long as the circuit board 2 is composed of two partial boards 21, 22 divided physically in the longitudinal direction of the dipole antenna 1, and the conductive patterns formed respectively thereon are the partial patterns arranged with a gap interposed therebetween in the longitudinal direction of the dipole antennas 1. Furthermore, the gap between the two partial boards 21, 22 are not necessarily positioned at the feeding point 3 of the dipole antenna 1. The circuit board 2 may be formed of three or more partial boards. Furthermore, the two partial boards 21, 22 may be composed by dividing a single board for mounting a circuit integrated from the viewpoint of functions, or a plurality of boards formed to mount separate circuits may be arranged in the longitudinal direction of the dipole antenna 1.

In the explanation for the present embodiment, the resistive circuit element 8 has a resistance value of 10 MΩ. The resistance value of the resistive circuit element in use can be modified appropriately in accordance with the frequency of signals to be received by the dipole antenna 1. It is preferable that the resistance value of the resistive circuit element 8 is selected by taking the following factors into consideration. Namely, it is the value selected such that, as a result of connecting with the resistive circuit element 8, the difference in the potentials between the two ground patterns is prevented from being left uncontrolled, and that at the same time, the time constant for the difference in potentials between the two ground patterns to shift to equipotential is longer than the frequency period of the signal to be received by the dipole antenna 1.

Embodiment 4

Next, a wireless receiver of Embodiment 4 will be described.

Figure 10:
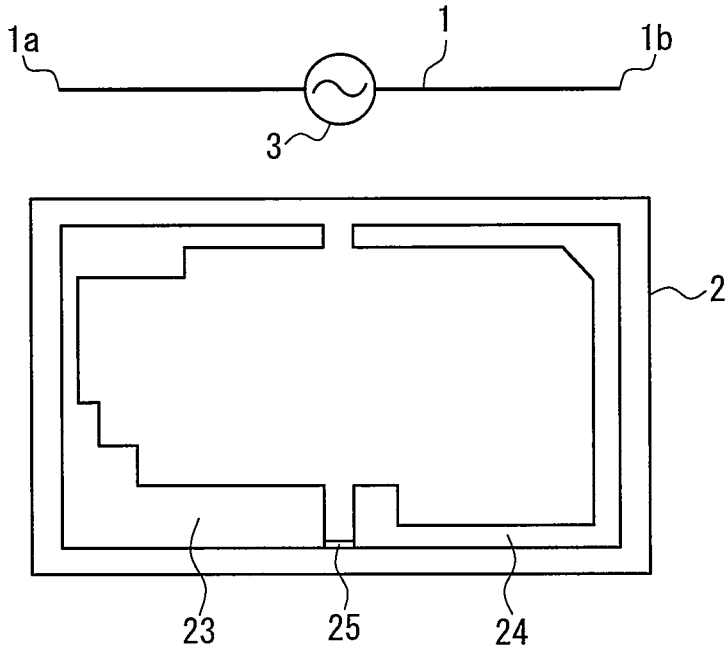
FIG. 10 is a diagram showing an example of a schematic configuration of a wireless receiver according to Embodiment 4 of the present invention.

FIG. 10 is a diagram showing a schematic configuration of a wireless receiver according to Embodiment 4. FIG. 10 shows the positional relationship between a dipole antenna 1, a circuit board 2 and a feeding point 3, each arranged within a housing (not shown) of the wireless receiver. FIG. 10 corresponds to FIG. 1 showing a schematic configuration of a wireless receiver in Embodiment 1.

In the wireless receiver according to Embodiment 4 as shown in FIG. 10, the circuit board 2 is not composed of two or more partial boards but the circuit board 2 is formed as a single board. However, the ground pattern formed thereon is composed of two partial patterns, i.e., a first ground pattern 23 and a second ground pattern 24, which are arranged with a gap interposed therebetween in the longitudinal direction of a dipole antenna 1.

In a case where the circuit board 2 is a single-layered board, for the purpose of keeping the ground potential stable without being subjected to influences of the wiring resistance, the ground patterns 23, 24 often are formed as wide patterns at the periphery or the like of the circuit board 2 as shown in FIG. 10. In such a case, as shown in FIG. 10, the ground patterns 23 and 24 are formed as two partial patterns separated with a predetermined gap on the circuit board 2, so that the ground patterns 23 and 24 can be prevented from functioning as a reflector for the dipole antenna 1 and from degrading the circuit characteristics in the horizontal direction.

FIG. 10 shows a state where the ground patterns 23 and 24 as the two partial patterns are connected to each other with an interconnect line 25 in a region on the circuit board 2 distal relative to the dipole antenna 1. In a case where the two ground patterns 23, 24 formed as partial patterns are connected directly to keep an equal potential, similarly to the case of the interconnect line 6 arranged distally relative to the dipole antenna 1 shown as an application example of Embodiment 1, the ground patterns 23, 24 can be connected to each other with the interconnect line 25 formed distally relative to the dipole antenna 1. In place of the connect line 25 as shown in FIG. 10, the low-pass circuit portion 7 in Embodiment 2 and the resistive circuit element 8 in Embodiment 3 can be used respectively to connect the ground patterns 23, 24 formed as partial patterns.

In the example as shown in FIG. 10, the ground patterns 23, 24 on the circuit board 2 are formed as partial patterns arranged with a gap interposed therebetween. In a case where a wiring to provide a power source potential is formed as a wide power source pattern on the circuit board 2 similarly to the ground patterns 23, 24, it is required to form the power source pattern similarly as partial patterns formed with a gap interposed therebetween.

When the ground pattern or both the ground pattern and the power source pattern is/are provided as partial patterns on the circuit board 2, the gap is not necessarily linear. The position of the gap is not necessarily at the feeding point 3 of the dipole antenna 1, i.e., in the middle part in the longitudinal direction. And the number of the partial patterns is not limited to two, namely, each ground pattern or the power source pattern can be formed of three or more partial patterns. These conditions are similar to those for any of the above Embodiments 1-3 where the circuit board 2 itself is composed of a first partial board 21 and a second partial board 22.

Each of the wireless receivers explained in the above embodiments has a dipole antenna 1 arranged together with a circuit board 2 within a housing. Therefore, even if the distance between the dipole antenna 1 and the circuit board 2 is short, degradation in the reception characteristics can be prevented effectively by providing the conductive patterns formed on the circuit board 2 as two or more partial patterns arranged at positions in between both ends of the dipole antenna 1, with a gap interposed therebetween.

Figure 11:
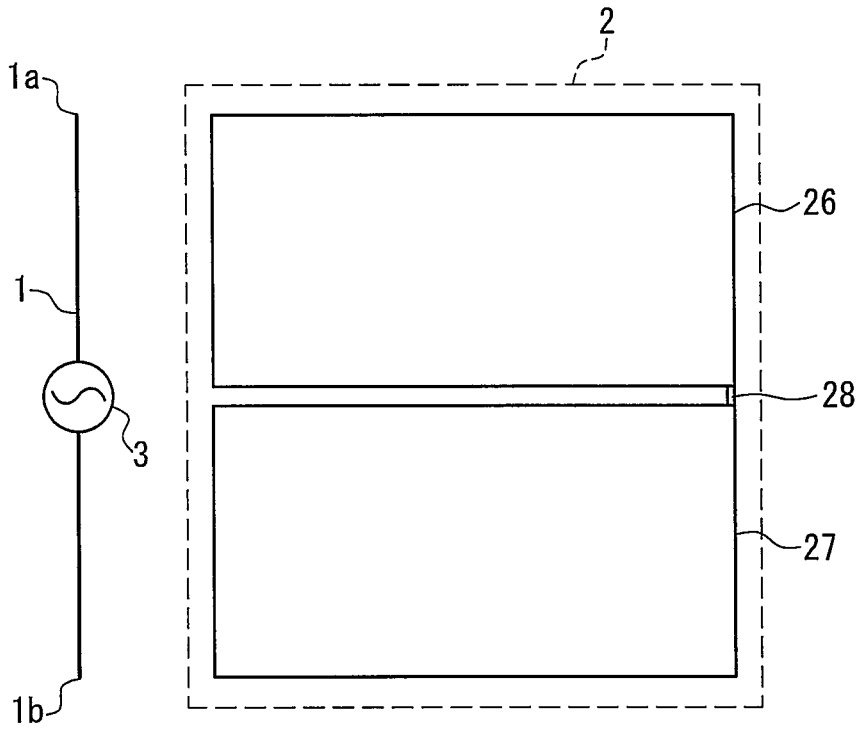
FIG. 11 is a diagram showing an example of a schematic configuration of a wireless receiver according to an embodiment of the present invention where an antenna is arranged at a different position.

As shown in FIG. 11, in a case of arranging the dipole antenna 1 in the horizontal direction of the circuit board 1, namely, in the transverse direction in FIG. 11, the longitudinal direction of the dipole antenna 1 becomes the vertical direction in FIG. 11, namely, the perpendicular direction of the wireless receiver. In this case, as shown in FIG. 11, the circuit board 2 is provided as two partial boards composed of a first partial board 26 positioned above and a second partial board 27 positioned below, thereby degradation in the reception characteristics of the dipole antenna 1 can be prevented. Namely, effects similar to those of the wireless receivers in any of the above-described embodiments can be obtained.

In a case of arranging the dipole antenna 1 in the horizontal direction relative to the circuit board 1, the ground patterns of the circuit boards 26, 27 can be connected to each other with an interconnect line 28 arranged distally relative to the dipole antenna 1, a low-pass circuit portion (not shown) or a resistive circuit element (not shown). Needless to note, as described in the respective embodiments, the shape of the gap between two partial boards is not necessarily linear, the position for dividing the partial boards is not necessarily at the feeding point 3 in the middle part of the dipole antenna 1, and the circuit board 2 may be composed of three or more partial boards.

Furthermore, the conductive pattern on a single circuit board 2 can be formed as partial patterns separated in the vertical direction on the circuit board 2, as described in Embodiment 4 with reference to FIG. 10.

In the above explanation on the respective embodiments for the wireless receivers of the present application, a ground pattern and a power source pattern are referred to as examples of the conductive patterns. However, in a case where any wide conductive pattern for providing a potential other than the ground potential or the power source potential is formed on the circuit board, the conductive pattern similarly may be required to be formed as partial patterns arranged with a gap interposed therebetween in the longitudinal direction of the balanced feed antenna in order to prevent degradation in the antenna characteristics.

In a case where the circuit board used for the wireless receiver is a multilayered circuit board, or in a case where a plurality of circuit boards are arranged as a laminate within the wireless receiver, it is required that each of the conductive patterns formed on the circuit boards of all the layers is composed of two or more partial patterns arranged with a gap interposed therebetween, where the gap is formed at a position in between the both ends of the balanced feed antenna.

INDUSTRIAL APPLICABILITY

The wireless receiver according to the present application can be made compact since a dipole antenna is included together with a circuit board in a housing. Therefore, the wireless receiver having excellent reception characteristics can be used favorably for various wireless receivers for portable use or the like.

The invention claimed is:

1. A wireless receiver comprising:

a balanced feed antenna; and a circuit board arranged in parallel to the longitudinal direction of the balanced feed antenna, wherein a conductive pattern formed on the circuit board is composed of two or more partial patterns arranged in the longitudinal direction of the balanced feed antenna with a gap interposed therebetween, the gap being formed at a position in between both ends of the balanced feed antenna, and the conductive pattern is a ground pattern to be connected to a ground potential.

2. The wireless receiver according to claim 1, wherein the circuit board is composed of two or more partial boards arranged in the longitudinal direction of the balanced feed antenna, so that the conductive pattern is composed of the two or more partial patterns.

3. The wireless receiver according to claim 1, wherein the two or more partial patterns are connected to each other with an interconnect line arranged on the circuit board distally relative to the balanced feed antenna.

4. The wireless receiver according to claim 1, wherein the two or more partial patterns are connected to each other with a low-pass circuit portion.

5. The wireless receiver according to claim 4, wherein the low-pass circuit portion does not transmit a frequency band component of a signal received by the balanced feed antenna.

6. The wireless receiver according to claim 1, wherein the two or more partial patterns are connected to each other with a resistive circuit element.

7. The wireless receiver according to claim 1, wherein the balanced feed antenna is arranged at a position on an extension of the circuit board.

8. The wireless receiver according to claim 1, wherein the balanced feed antenna is arranged above the circuit board during use of the wireless receiver.

9. The wireless receiver according to claim 1, wherein the balanced feed antenna is arranged laterally relative to the circuit board during use of the wireless receiver.

10. The wireless receiver according to claim 1, wherein the balanced feed antenna is a dipole antenna.

11. The wireless receiver according to claim 1, wherein the balanced feed antenna is a folded dipole antenna.

* * * * *